US007022380B2

(12) United States Patent
Lan et al.

(10) Patent No.: US 7,022,380 B2
(45) Date of Patent: Apr. 4, 2006

(54) METHOD AND APPARATUS FOR THE HIGH SPEED APPLICATION OF COATING TO A TRAVELING PAPER WEB

(75) Inventors: Xuekui Lan, Woodridge, IL (US); Brian J. George, Rockton, IL (US)

(73) Assignees: Metso Paper, Inc., Helsinki (FI); Mitsubishi Heavy Industries, Tokyo (JP)

( * ) Notice: Subject to any disclaimer, the term of this patent is extended or adjusted under 35 U.S.C. 154(b) by 1086 days.

(21) Appl. No.: 09/763,214

(22) Filed: Feb. 2, 2001

(65) Prior Publication Data

US 2005/0051084 A1 Mar. 10, 2005

Related U.S. Application Data

(63) Continuation of application No. PCT/US97/17417, filed on Sep. 26, 1997.

(60) Provisional application No. 60/051,471, filed on Jun. 30, 1997.

(51) Int. Cl.
*B05D 3/12* (2006.01)
*B05C 11/10* (2006.01)

(52) U.S. Cl. ..... 427/345; 427/356; 427/359; 427/361; 118/602; 118/118; 118/119; 118/123; 118/126

(58) Field of Classification Search ..... 427/345, 427/356, 358, 359, 361; 118/602, 110, 118, 118/119, 123, 126, 413, 414
See application file for complete search history.

(56) References Cited

U.S. PATENT DOCUMENTS

| | | | | | |
|---|---|---|---|---|---|
| 4,396,648 | A | * | 8/1983 | Holt et al. | 427/356 |
| 4,834,018 | A | * | 5/1989 | Sollinger et al. | 118/410 |
| 4,920,913 | A | | 5/1990 | Knop et al. | |
| 4,945,855 | A | * | 8/1990 | Eklund et al. | 118/407 |
| 5,173,120 | A | | 12/1992 | Suzumura | |
| 5,192,591 | A | | 3/1993 | Chance | |
| 5,376,177 | A | * | 12/1994 | Elvidge et al. | 118/410 |
| 5,665,163 | A | * | 9/1997 | Li et al. | 118/413 |
| 5,824,369 | A | * | 10/1998 | Li et al. | 427/345 |

FOREIGN PATENT DOCUMENTS

| | | | |
|---|---|---|---|
| EP | A2 0514735 | | 11/1992 |
| WO | 97/08385 | * | 3/1997 |

* cited by examiner

*Primary Examiner*—Katherine Bareford
(74) *Attorney, Agent, or Firm*—Stiennon & Stiennon

(57) ABSTRACT

Method and apparatus for coating a traveling paper web includes a coater head. The coater head includes an inlet for receiving fresh coating material which is introduced into a mixing chamber. A looped flow path is established within the coater head which includes a feed channel extending from the mixing chamber and leading into a coating chamber where one portion of the coating material proceeds in the direction of the rotating backing roll. The aqueous slurry of coating material near the downstream end of the coating chamber enters a recirculation channel from which it is directed through a plurality of flow metering orifices back into the mixing chamber.

6 Claims, 7 Drawing Sheets

METHOD AND APPARATUS FOR THE HIGH SPEED APPLICATION OF COATING TO A TRAVELING PAPER WEB

CROSS REFERENCES TO RELATED APPLICATIONS

This application is a continuation of PCT/US 97/17417 filed Sep. 26, 1997 which claims priority from Provisional Application 60/051,471 filed Jun. 30, 1997, now abandoned.

BACKGROUND OF THE INVENTION

1. Field of the Invention

This invention relates to the application of coating to a traveling paper web. More specifically, this invention relates to a method and apparatus for the high speed application of a film of coating material to the paper web utilizing a looped circulation path having a web interface which moves in the direction of the traveling paper web. Still more particularly, this invention relates to a method and apparatus for the application of a film of either relatively low or high viscosity coating materials, such as sizing and pigmented coating, respectively, at relatively high speeds to a traveling paper web.

2. Description of the Prior Art

One of the major problems with a conventional metering size press, which applies an aqueous slurry of sizing in an almost water-like consistency, as well as a conventional coater, which applies an aqueous slurry of pigmented coating material, which can be quite viscous in its consistency, both applied as a film to a traveling paper web, is the occurrence of two phenomena known in the papermaking industry as skip-coating and non-uniform streaks on the paper web, particularly at high machine speeds. In skip-coating, the film of coating material is intermittently interrupted in the direction of paper travel, while in non-uniform coating, machine-direction streaks of coating on the paper web have different thicknesses in the cross-machine direction. Both phenomena adversely affect the coating operation, and in many cases result in an unacceptable coated paper product.

In general, the problems relating to the non-uniform application of coating material to a traveling paper web at relatively high speeds have their basis in the failure in preventing air from entering the coating process and unfavorable vortex development in the coater head as the machine speed increases. Thus, while it is relatively easy to apply coating uniformly to a paper web traveling at 800 m/minute, for example, when machine speeds increase to relatively high speeds, such as about 1800 m/minute, for example, the dynamics of the coating process, such as the frictional interface of the traveling paper web, in a coater, or of the backing roll surface, for size press configuration, with ambient air, as well as small under- and over-atmospheric pressures created by the dynamics of the flowing coating material, induce entrained air within the aqueous slurry of coating material, which promotes the aforementioned problems.

In existing coating processes, particularly for the application of a film of relatively low viscosity, water-like sizing to printing grade types of paper, the aqueous slurry of coating material supplied to the channel or chamber exposed to the surface of the traveling paper web on a coater, or the backing roll surface, in the case of a metering size press, either flows against the paper web and out of the coater head at the downstream end, or is divided into two portions, with one portion flowing downstream and the other portion flowing upstream over a baffle and out of the coater head.

The problem with these arrangements is that neither of them works well at relatively high speeds, such as about 1800 m/minute, or greater. In the first case, because of the development of the unfavorable vortex, air is readily brought into the coating chamber by its frictional engagement with the surface of the traveling paper web (coater) or the backing roll for a metering size press. In the second case, due to the division of the flow of the coating material into upstream-directed and downstream-directed portions, in order to prevent entrainment of air traveling with the paper web or backing roll surface into the coating chamber, the flow of the portion of coating material upstream over the baffle must be sufficiently great such that there is then either an insufficient supply is coating material in the portion supplied to the coating chamber to properly coat the paper web traveling at the relatively high speed, or there is sufficient coating material to coat the paper web, but such coating is deleteriously effected due to insufficient coating in the portion flowing upstream over the baffle wall to prevent air from entering the coating chamber to be entrained in the coating material.

Some of these problems can be mitigated by either utilizing a more powerful pump, or a pump with a higher capacity for supply more coating material to the coater head. However, paper manufacturers are reluctant to incur the extra capital and operating costs associated with these alternatives. They prefer to operate with a minimum amount of coating material.

Other known prior art is shown and described in U.S. Pat. Nos. 4,834,018; 4,920,913: 5,173,120 and 5,192,591; and EP-A-0 514 735.

These documents all relate to either methods or apparatus, or both, regarding short dwell types of coater. This is the same type of coater to which this invention pertains.

In the US '018 document, there is recirculation of the coating material as well as combining the recirculated coating material with fresh coating material entering the apparatus.

In the US '913 document, there also is shown recirculation of coating material and mixture with fresh coating material.

In the EP '735 document, the fresh coating material is shown being split into upstream and downstream directed components.

In the US '120 document, a portion of the coating material is shown being directed upstream against the movement of the paper web and backing roll, and a portion of a coating material is shown being redirected back into the in-coming fresh supply of coating material.

In the US '591 document, coating material is shown being split into two portions, one portion being directed against the paper web to be coated, and the other portion being directed out of the coater head.

None of these documents show or describe a mixing chamber used in conjunction with a flow of recirculated coating material directed into the stream of fresh coating material at an acute angle.

SUMMARY OF THE INVENTION

The deficiencies and limitations of existing coating apparatus for coating a traveling paper web with a film of coating material, including metering size presses and coaters for applying pigmented coating materials, both of which utilize coating applied to the traveling paper web, particularly at relatively high speeds, are obviated by this invention. In this invention, a flow loop is established within the coater head where a fresh supply of an aqueous slurry of coating material is brought into the coater head and is directed into a mixing chamber. In a preferred embodiment, a plurality of flow-metering orifices also link a recirculation channel within the coater head in fluid communication with the mixing chamber. A feed channel is in fluid communication with the mixing chamber, downstream thereof, for receiving the aqueous slurry of coating material from the mixing chamber. The feed channel leads toward the backing roll.

Near the end of the feed channel, the aqueous slurry is divided into two portions comprising, in a preferred embodiment, a major portion which travels downstream into a coating chamber and a minor portion which is urged by the hydraulic pressure in the feed channel to flow upstream over the edge of a baffle against the movement of the paper web traveling into the coater head.

The flow of the aqueous slurry in the coating chamber may utilize a blade, which preferably is relatively flexible and which forms the coating chamber, in a preferred embodiment, into a converging channel extending downstream in the machine direction. Alternatively, the coating chamber may not utilize such a flexible blade. In the case where no flexible blade is utilized, the coating chamber is defined between a relatively rigid stabilizer surface of the coater head extending downstream from the feed channel, and the surface of the backing roll. In operation of the coater embodiment, of course, the backing roll surface is covered by the paper web supported against the rotating backing roll. Therefore, for purposes of defining the side of the coating chamber against the backing roll, this side/surface is intended to include the backing roll with or without the paper web supported by the backing roll.

Whether or not a blade is used, a recirculation channel is formed in the coater head either on the side of the flexible blade facing away from, the backing roll or, in the case where no blade is utilized, the recirculation channel is more distantly spaced radially from the outer surface of the backing roll (metering size press) embodiment, or from the paper web over the backing, roll (coater embodiment) and perhaps even partially located somewhat beneath the relatively rigid stabilizer surface. The recirculation channel is maintained in fluid communication with the mixing chamber preferably through a plurality of flow metering orifices.

Thus, a looped flow path is established for the aqueous slurry to flow in the same direction as the direction of travel of the paper web and/or the rotation of the backing roll which, in the coater embodiment, supports the paper web on one side of the coating chamber. This arrangement utilizing recycled coating from the recirculation channel facilitates flow through the coating chamber without requiring an increased flow of fresh coating material into the coater head, particularly in an amount commensurate with the increased speed of paper web travel. A serendipity effect of this arrangement is that the flow of the aqueous slurry in the upstream direction over the baffle can simultaneously be maintained at a high enough volume sufficient to prevent the flow of air traveling with the surface of the backing roll (metering size press embodiment) or of the uncoated paper web (coater embodiment) from entering the coating chamber, or at least entering in an amount sufficient to deleteriously affect the condition of the coating operation as it pertains to skip coating and non-uniform streaks in the coated paper product.

Downstream of the coating chamber is a metering rod which is held in a rod holder in biased nipping engagement against backing roll surface, or the surface of the paper web supported over the surface of the backing roll. In a preferred embodiment, this round rod is rotated in a direction such that its surface moves counter to the direction of the backing roll surface/traveling paper web. This smooths, or meters, the coating on the outer surface of either the backing roll or the paper web traveling through the application chamber as well as helps create some hydraulic over-pressure in the recirculation channel for urging coating material passing out of the coating chamber into the recirculation chamber and through the flow-metering orifices for recirculation.

It is this recirculation which permits the coating function to be effected at relatively higher speeds without requiring larger pumps to supply the aqueous slurry of coating material to the coater head, or a greater supply of the aqueous slurry of coating material, or both, in order to provide the desired results.

The invention can be used to improve the coating quality and increase the coating speed in both coater and size press operations. In coater operations, the coating is directly metered onto the paper web wrapping the backing roll. The invention will lead to a uniform coating application on the paper web without skip coating at high speed. In size press operations, the coating is metered onto the backing roll. The invention will ensure a uniform coating film on the backing roll without skip coating at high speed, which film is eventually transferred into a high quality coating on the paper web.

Accordingly, it is an object of this invention to provide an improved coating apparatus for coating a paper web traveling at relatively high speeds.

A feature of this invention is the provision of coating apparatus having a continuous, looped flow path within a coater head for recirculating a portion of the coating within the coater head.

Another feature of this invention is the provision of coating apparatus wherein the recirculation of a portion of the coating to be combined with fresh coating entering the inlet of a coater head.

Still another feature of this invention is the provision of coating apparatus which utilizes recirculation of a first portion of the coating, and utilizes a second portion of the coating to effectively seal a traveling paper web from air being entrained in the coating.

These, and other objects, features and advantages of this invention will become apparent to those skilled in the art upon reading the description of the invention and preferred embodiments in conjunction with the attached drawings.

DESCRIPTION OF THE PREFERRED EMBODIMENT

In this invention, the term "coating" is used in a broad sense to denote an aqueous slurry of coating material, which coating material might comprise sizing, such as used in a size press, or pigmented coating, such as used in a conventional coater. An aqueous slurry of sizing is quite non-viscous and flows substantially like water. On the other hand, an aqueous slurry of pigmented coating material, which pigment might comprise, for example, titanium dioxide or calcium carbonate, is very viscous and does not readily flow at all.

Similarly, the term "coater" is used herein to denote all coaters, regardless of whether they might be more specifically known as size presses or another specific type or configuration of coater.

Figure 1:
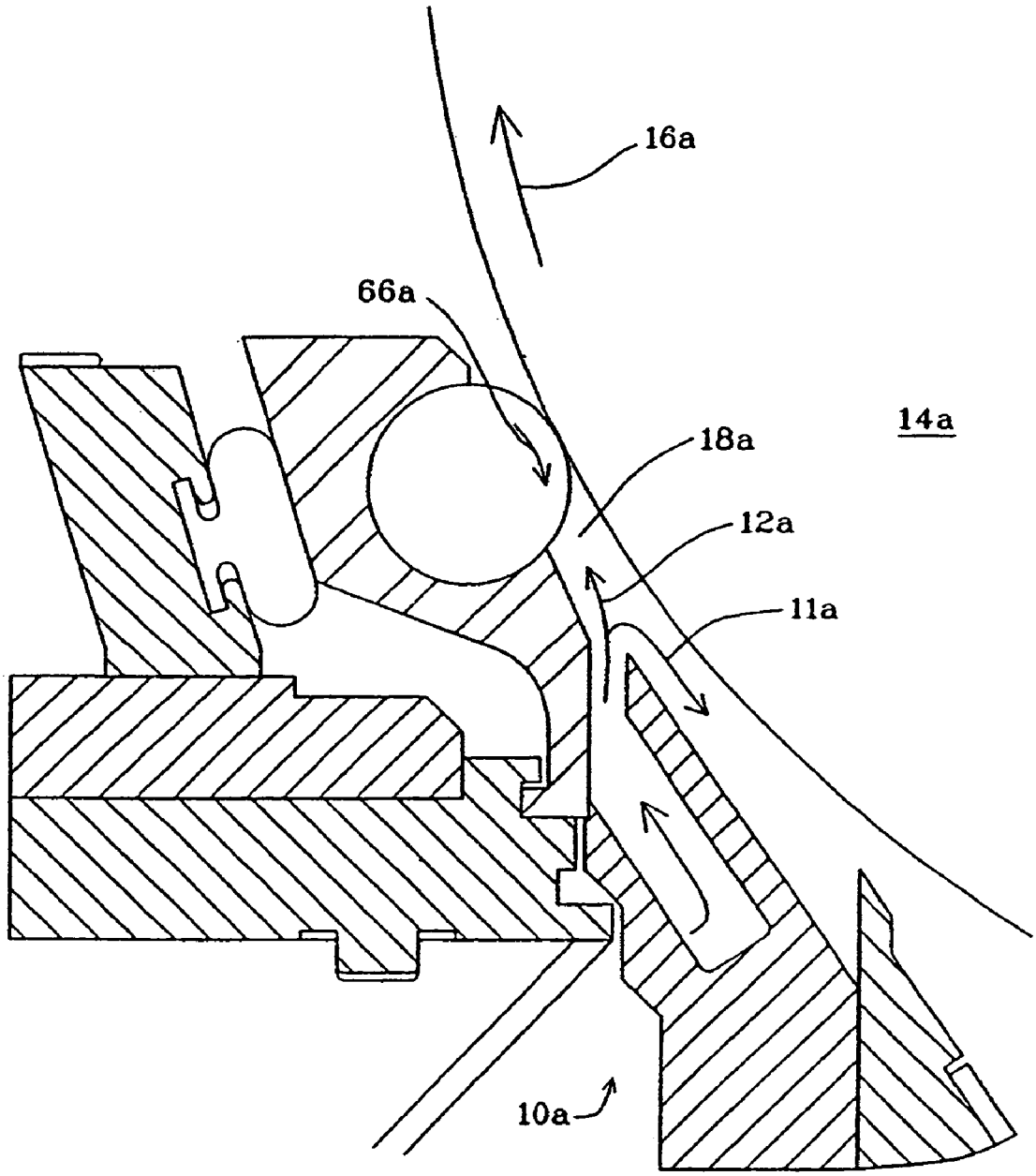
Fig. 1 (Prior Art)
FIG. 1 is a side elevational view in section, shown somewhat schematically, of a known configuration for a metering size press type of coater.

In the various embodiments; including the known embodiment shown in FIG. 1, the same numbers will be used to identify corresponding or similar elements, but with alphabetical suffixes to distinguish between specific elements. Similarly, the same element which is used twice in the same embodiment is designated with a prime mark in the second occurrence.

Figure 2:
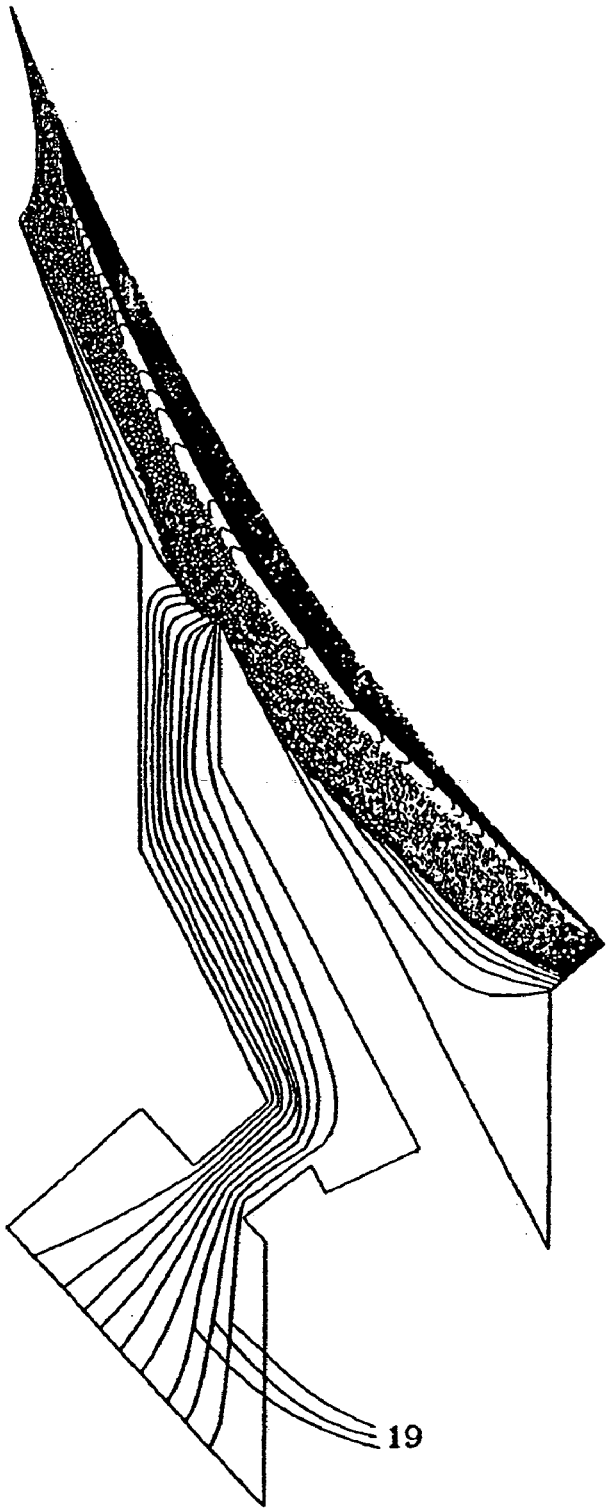
Fig. 2 (Prior Art)
FIG. 2 shows streamline patterns for the conventional metering size press of the type shown in FIG. 1.

Referring to FIG. 1, in a conventional, known type of metering size press, the flow of coating into the coater head shown by the flow arrow designated 10*a* is divided into upstream-flowing and downstream-flowing portions 11*a*, 12*a*, respectively. The direction of rotation of backing roll 14*a* is shown by arrow 16*a*. This division of coating flow is so significant that the portion of the coating flowing upstream against the direction of web travel on the surface of the backing roll is insufficient to prevent air from entering the coating chamber 18*a*. Therefore, the coating apparatus is speed-limited because even at a relatively low speed, such as about 1,000 m/minute, the portion of the coating flowing upstream is insufficient to prevent air from entering the coating chamber. This phenomenon is depicted graphically by the stream-flow lines 19 shown in FIG. 2.

In coater/size press terminology, "downstream" is the direction of travel of the paper web or the direction of rotation 16, 16*a* of the backing roll 14, 14*a*.

Figure 3:
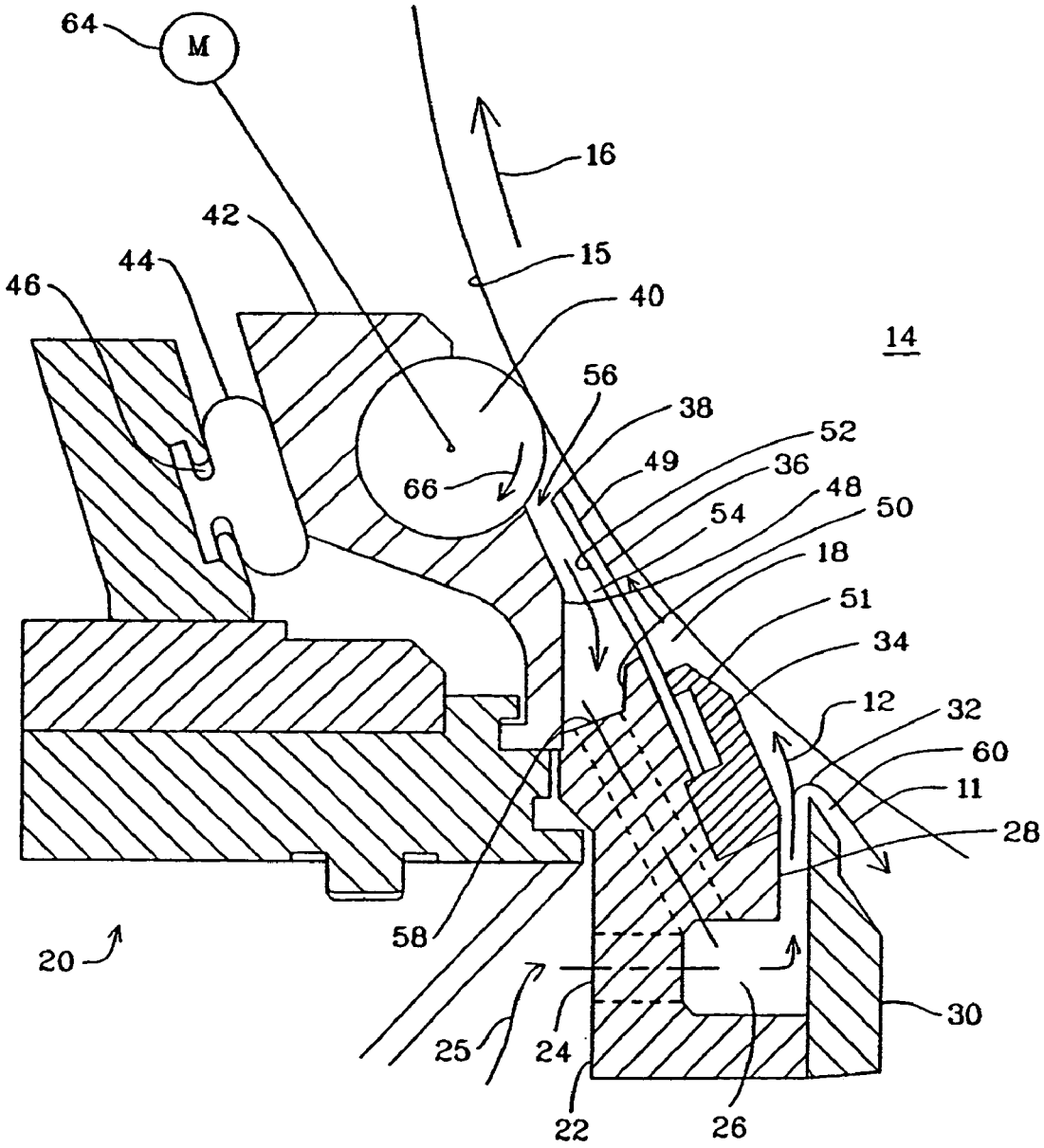
FIG. 3 is a side elevational view in section, shown somewhat schematically, of a preferred embodiment of the coating apparatus of this invention which utilizes a blade in the coating chamber.

Referring to FIG. 3, in this invention, coating apparatus, designated generally by the numeral 20, includes a coater head 22. An inlet 24 is formed in the coater head for admitting fresh coating 25 from an outside source, not shown, for preparing a new, or fresh, supply of coating to be supplied to the coater head. The inlet, which preferably comprises a plurality of parallel holes aligned in the cross-machine direction, leads into a mixing chamber 26. A feed channel 28 leads out of the mixing chamber and extends upwardly, as shown in FIG. 3, toward the surface 15 of the backing roll 14.

Since the apparatus shown in FIG. 3 (and in FIG. 5) is generic to that used in both a metering size press and a coater embodiment, the coater head may either bear directly against the surface of the backing roll (size press embodiment) or against a paper web (not shown in FIG. 3) supported on the surface of the backing roll (coater embodiment). A baffle 30 having an edge 32 forms an upstream wall of the feed channel with the edge disposed in closely-spaced adjacency with the surface of the paper web over the backing roll to form a gap between them.

Figure 5:
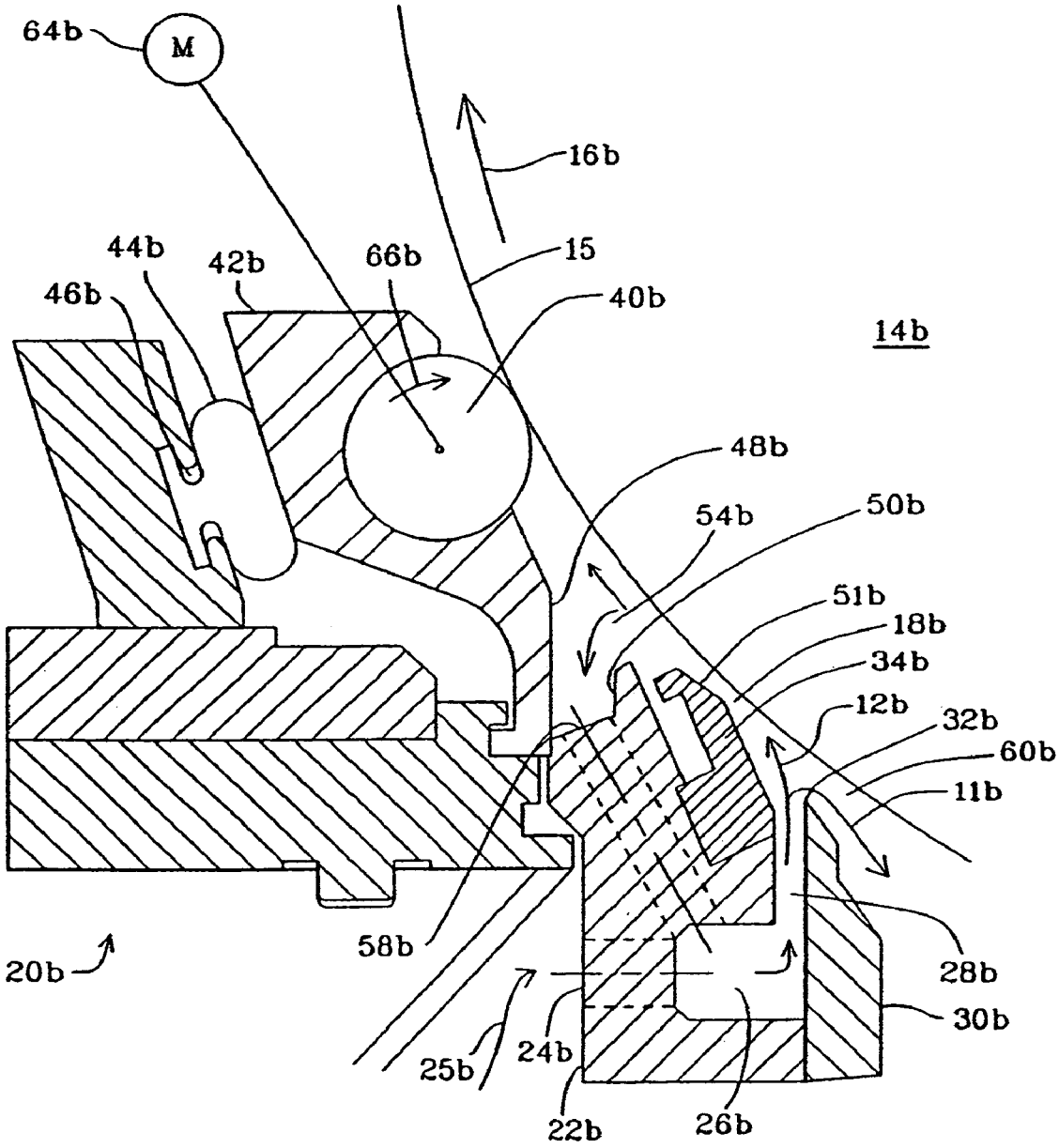
FIG. 5 is a side elevational view of another embodiment of the metering size press, or coater, of this invention, shown somewhat schematically, and similar to the embodiment shown in FIG. 3, and which does not utilize a blade.

The feed channel 28 is in fluid communication with a coating chamber 18 which extends downstream in the coater head from the downstream opening of the feed channel. The coating chamber is open in the direction facing the backing roll (metering size press embodiment) or the paper web supported on the surface of the backing roll 14 (coater embodiment). In other words, when the coater apparatus shown in FIGS. 3 and 5 is used in a coater, the coater head 22*d* is in the embodiment shown in FIG. 6A. When the coater apparatus shown in FIGS. 3 and 5 is used in a metering size press embodiment, the coater heads 22*c*, 22*c*' are in the embodiment shown in FIG. 6.

In this description, it is understood that the various structural elements, such as feed channel edge 32, feed channel 28, mixing chamber 26, as well as other items of the coating apparatus, extend in the cross-machine direction, which is perpendicular to the plane of the paper on which the figures are shown, longitudinally for the effective width of the apparatus. Thus, there are edge walls on either end of the coating apparatus, but such end walls are not shown for purposes of clarity in viewing the figures. The figures are also shown in cross-section for the same reasons of clarity.

Still referring to FIG. 3, a flow stabilizer 34 is mounted within the coater head and, in this preferred embodiment, a blade 36 extends downstream from its clamped mounting in the flow stabilizer with at least a portion of the blade's downstream-extending length being arrayed to make the coating chamber 18 substantially converging in the downstream direction. The blade is preferably flexible and has a distal end 38 which effectively defines the end of the coating chamber 18. The coater chamber is thus effectively defined by the surfaces of the flow stabilizer and blade surface 49 facing the backing roll and the surface of the backing roll (and the web supported on the backing roll) facing the blade.

Near the downstream end of the blade, a metering rod 40 is rotatably mounted in a rod holder 42, which in turn, is mounted in the coater head by a suitable means, such as being clamped by the structure as shown in FIG. 3. An inflatable tube 44, which extends longitudinally in the cross-machine direction, is also mounted into the coating apparatus by suitable means, such as being press-fit into a slot 46 as shown in FIG. 3, and is operable by being attached to a source of compressed air (not shown) to bias the flexible (i.e,. plastic), or flexibly mounted, metering rod holder to press the metering rod into nipping engagement with the backing roll 14.

A surface 48 of the metering rod holder and surfaces 50 of the coater head 20, and 52 of the blade facing away from the backing roll define a recirculation channel 54 which collects coating passing over the distal end of the blade as designated by arrow 56. At the other, lower, end of the recirculation chamber, referring still to the embodiment shown in FIG. 3, a plurality of flow-metering orifices 58 are formed in the coater head. These flow-metering orifices are aligned parallel with one another in the cross-machine direction. They extend longitudinally between the recirculation channel 54 and the mixing chamber 26.

In the embodiment shown in FIG. 5, the apparatus is essentially the same as that shown in FIG. 3, except that no blade 36 is utilized. In this embodiment, the outer, or top, surface 51*b* of the flow stabilizer 34*b* forms the side of the coating chamber 18*b* which is not formed by the surface of the backing roll. In other words, the top of the blade clamp comprises the flow stabilizer and its surface which defines one side of the coating chamber. Since the outer surface of the flow stabilizer is relatively more distantly spaced from the backing roll, and since there is no blade forming any convergence in the coating chamber downstream from where the blade would otherwise be clamped, the coating chamber is shorter in length and greater in height, as measured radially outwardly from the surface of the backing roll, all such that a greater quantity of coating can be accommodated in the coating chamber so that a greater flow rate of coating can be attained.

Thus, in the embodiment shown in FIG. 3 utilizing a blade, faster speeds can be accommodated at a lower flow rate. In the embodiment shown in FIG. 5, higher speeds can be accommodated with a higher coating flow rate.

Figure 4:
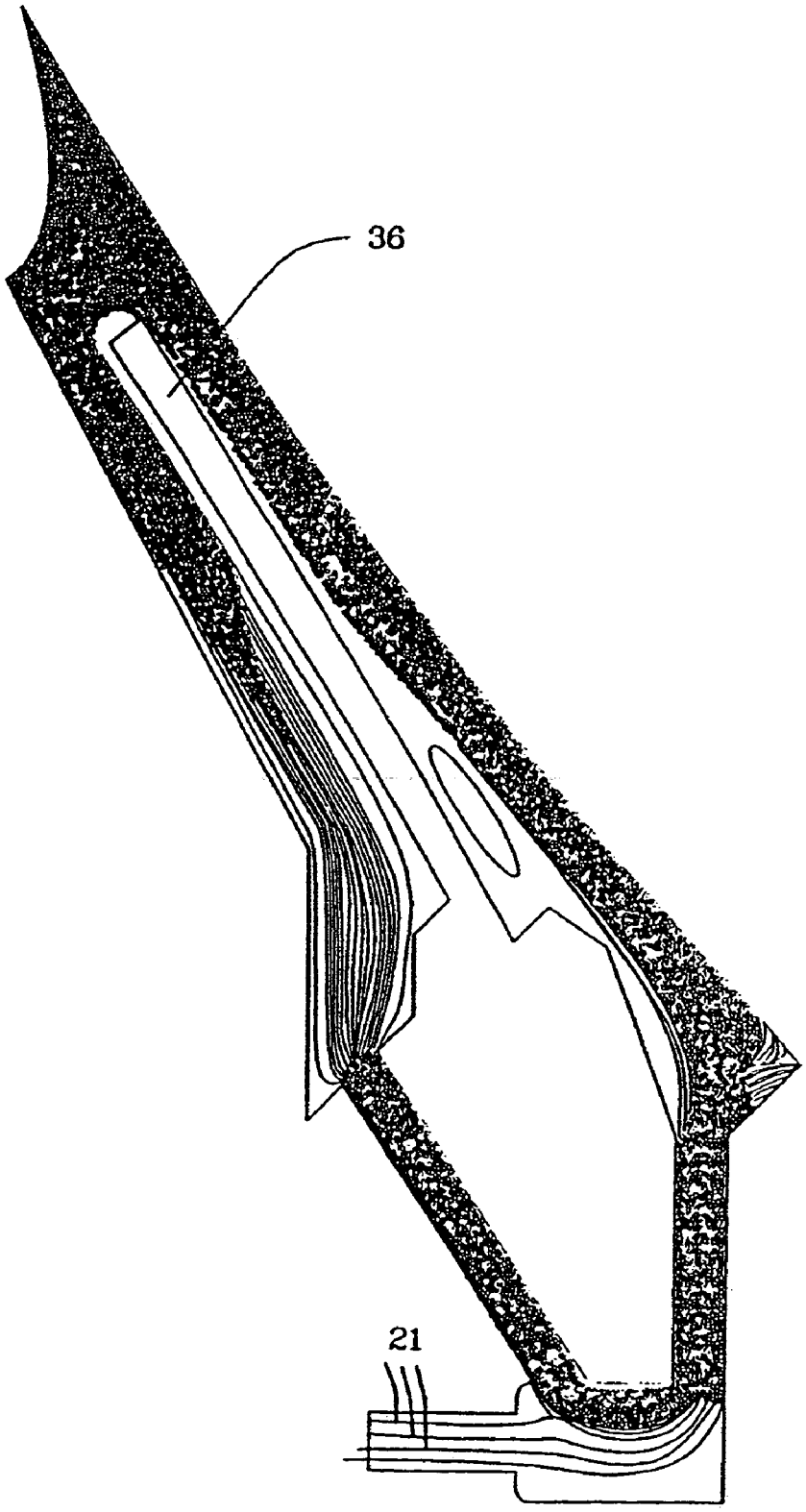
FIG. 4 is a view of the streamline patterns of the coating flowing through the coating apparatus shown in FIG. 3.
Figure 4A:
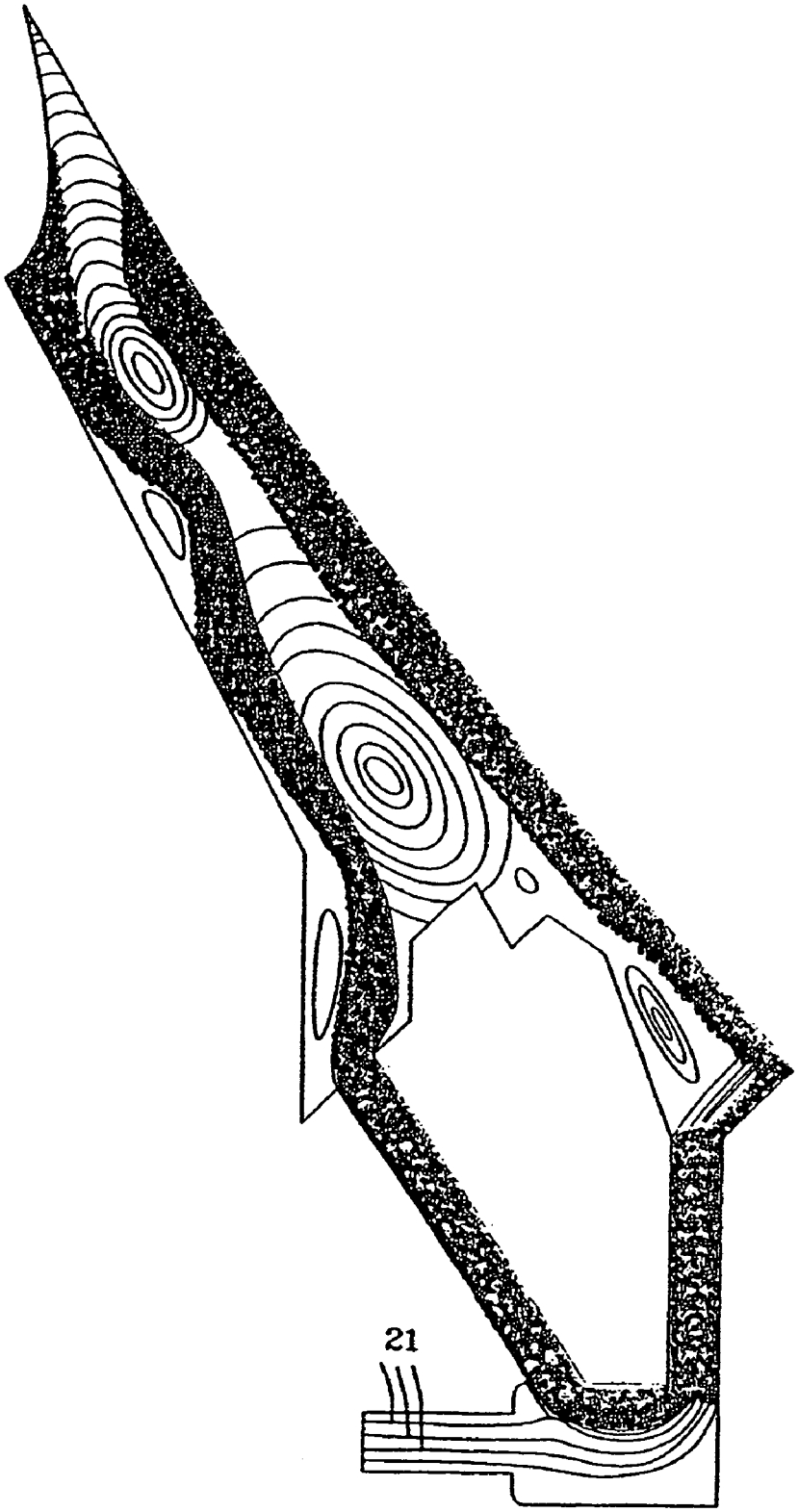
FIG. 4A is a view of the streamline patterns of the coating flowing through the coating apparatus similar to that shown in FIG. 3, but without the blade

With reference to FIGS. 4 and 4A, the stream flow lines 21 are substantially smooth and straight with essentially small curves. This is due in large part to the continuous, looped flow of the coating permitted and augmented by the recirculation chamber. The flow of fresh coating into the inlet and mixing chamber is not necessary at high volumes and pressures in order to sustain the coating process at high machine speeds. This also operates to reduce fluctuations and extremes in both the flow and hydraulic pressure of the coating within the coating chamber. Coating is essentially recirculated through the mixing chamber, feed channel, coating chamber, and recirculation channel until it is eventually applied to the traveling paper web. Because of the favorable recirculation flow pattern, there is less opportunity for flow instability and air entrainment to occur in the coater head. Also, due to the recirculation feature utilized in conjunction with the separate mixing chamber, less fresh coating, and the pumping capacity to supply it, is required in the coating.

Figure 6A:
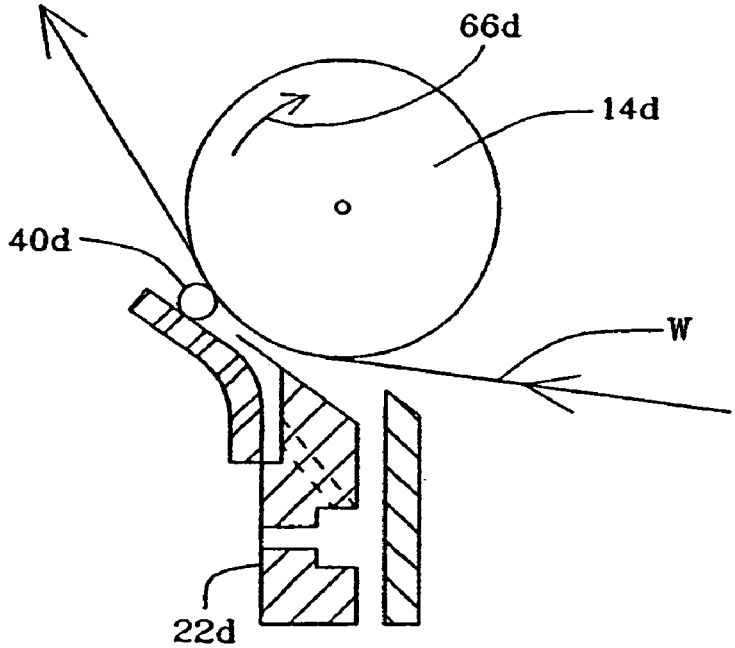
FIG. 6A is a side elevational view of the metering size press embodiment of this invention where the coating is applied directly, to the surface of a backing roll and two backing rolls are nipped over the traveling paper web.
Figure 6:
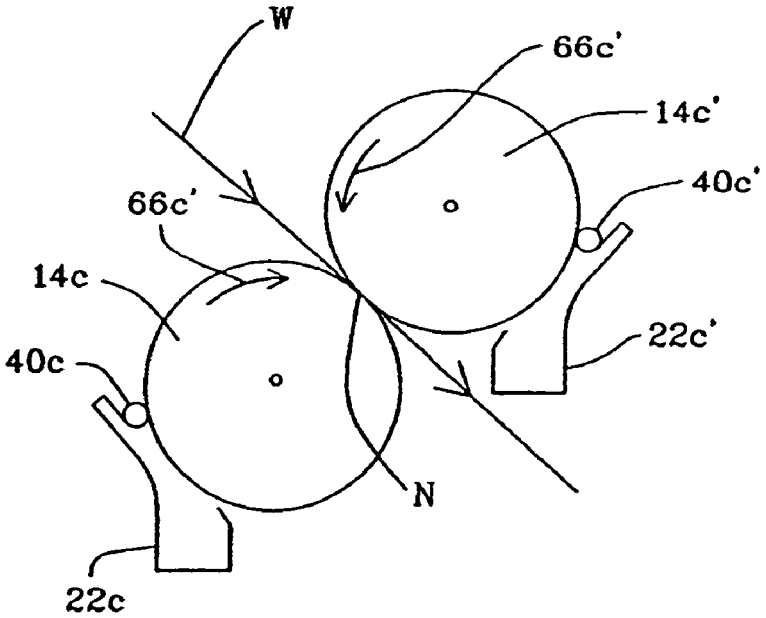
FIG. 6 is a side elevational view in section of the coater embodiment of this invention, shown somewhat schematically, where coating is applied directly to the traveling paper web.

FIGS. 6 and 6A illustrate the basic metering size press and coater embodiments, respectively, In the metering size press configuration (MSP), two coater heads 22*c*, 22*c*', of the type shown in more detail in FIGS. 3 and 5, are operatively disposed against the backing rolls 14*c*, 14*c*' which are nipped against the web W traveling through the nip N. The coater heads apply a coating film onto the surfaces of the backing rolls. This film is metered by the counter-rotating (relative to their respective backing rolls) metering rods 40*c*, 40*c*'. The smooth, even film is then applied to both sides of the traveling web W simultaneously in the nip N.

In the coating arrangement shown in FIG. 6A, the coater head 22*d* applies to coating onto one side of the web W which is carried and supported by the surface of backing roll 14*d*.

In operation, fresh coating is introduced under pressure into the inlet 24 in the coater head to be in turn introduced into the mixing chamber 26. This fresh coating is mixed with a supply of recirculated coating which is directed into the mixing chamber via the plurality of orifices 58 extending between the recirculation channel and the mixing chamber. The combined mixture of fresh and recirculated coating is then directed into the feed channel where it is divided into portions 11, 12 near the end of the feed channel. The inlet 24, mixing chamber 26, and feed channel 28 are separate and distinct. A first portion 12, which preferably comprises a major portion, is directed downstream into the coating chamber. A second portion 11, preferably comprising a minor portion is directed over the edge of the baffle into the gap 60 to form an effective seal against air being drawn into the coating chamber to be entrained in the coating by means of the frictional engagement of ambient air by the surface of the backing roll, in the metering size press embodiment, or by the paper web, in the coater embodiment, traveling at high speed into the coater head.

In the metering size press embodiment, shown in FIG. 6, each coater head 22*c*, 22*c*' has a film of coating metered onto the surface of a pair of backing rolls 14*d*, 14*d*' nipped over a traveling paper web W. The coating film is first metered directly onto the surfaces of the backing rolls by the counter-rotating metering rods 40*c*, 40*c*'. Then both sides of the web W are coated as the web passes through the nip N between the backing rolls.

In the coater embodiment, shown in FIG. 6A, the coating process occurs in the coating chamber as the outer surface of the web over the backing roll is brought into pressurized contact with the coating such that a continuous, uniform film of coating is deposited on the traveling paper web as the coating in the coating chamber flows in the same direction as the direction of rotation of the backing roll 16 and also the paper web.

Coating which is not applied to the paper web passes either beyond the distal edge 38 of the blade, or beyond the end 50 of the portion of the coater head which comprises the downstream extension of the flow stabilizer. In either case, the coating passes into the recirculation chamber 54 for entry into the orifices 58 for recirculation into the mixing chamber. This recirculation flow into the mixing chamber does not affect the flow of fresh coating into the inlet 24. Thus, a continuous, loop of coating flow is established within the coater head. The supply of fresh coating therefore needs only to meet the needs of coating which is actually applied to the surfaces of the traveling paper web and which flows over the baffle.

Downstream of the coating chamber, the metering rod is, in a preferred embodiment, powered by a motor 64 (FIGS. 3 and 5) which rotates the metering rod in a direction shown by arrow 66 which, in a preferred embodiment, is opposite to the direction of travel of the paper web or the surfaces of the backing rolls in the metering size press. This both provides very effective metering of the film applied to the paper web or backing rolls in the coating chamber as well as serving to maintain, or possibly slightly increase, the hydraulic pressure of the coating in the recirculation channel to aid in the looped flow of the coating in the coater head, particularly from the recirculation chamber to the mixing chamber.

Clearly, various modifications to the method and apparatus of this invention can be made without departing from the spirit and scope of the claims. Thus, the specific terms used to describe the preferred embodiments have been used in a generic and descriptive sense and not for purposes of limitations.

What is claimed is:

1. A method for coating a traveling paper web with a film of coating, the paper web being either supported on the surface of a backing roll rotating in a downstream direction, or nipped against the surface of the backing roll, the method comprising the steps of:

introducing a fresh supply of coating into a mixing chamber of a coater head and directing the fresh supply of coating into the mixing chamber in the coater head through a plurality of parallel holes aligned in a cross-machine direction;

flowing a coating flow from the mixing chamber in a converging flow into, and through, a feed channel in the coater head;

dividing the coating exiting the feed channel into a first portion constituting a major part of the flow from the mixing chamber and a second portion constituting a minor part of the flow from the mixing chamber;

directing the first portion into a coating chamber in the coater head, and directing the second portion in an upstream direction over a baffle disposed in spaced adjacency with either the paper web supported on the backing roll, or the surface of the backing roll, to define a gap therebetween, the second portion being sufficient to seal the gap from air moving with either the traveling paper web or the surface of the backing roll;

flowing the coating in the coating chamber in the downstream direction therein while maintaining a pressurized interface between the coating material and the paper web, when the paper web is supported on the surface of the backing roll to coat the paper web with the film of coating, or maintaining a pressurized interface between the coating material and the surface of the backing roll when the paper web is nipped against the surface of the backing roll downstream of the interface to coat the paper web with the film of coating;

flowing coating from the coating chamber into a recirculation chamber;

directing all the coating from the recirculation chamber into the mixing chamber through a plurality of flow-metering orifices formed in the coater head which are aligned parallel with one another in the cross-machine direction and which connect the recirculation chamber with the mixing chamber, the direction of flow of coating from the recirculation chamber through the plurality of flow-metering orifices being at an acute angle to the direction of flow of the fresh supply of coating being directed into the mixing chamber through the plurality of parallel holes; and mixing the coating from the recirculation chamber with the fresh coating in the mixing chamber.

2. The method of claim 1 further comprising the step of metering the film of coating against the surface of the backing roll or the paper web moving in a first direction, with a metering rod, the metering rod having a rod surface which engages along a contact line the backing roll or paper web on the backing roll, so that the rod surface at the contact line moves in a direction opposite that of the backing roll or the paper web at the contact line.

3. Apparatus for coating a traveling paper web with a film of coating, the apparatus operatively associated with an adjacent backing roll and comprising, in combination:

a coater head having an inlet for receiving a supply of fresh coating;

a mixing chamber in the coater head in fluid communication with the inlet for receiving the supply of fresh coating;

a feed channel in the coater head in fluid communication with the mixing chamber for receiving coating from the mixing chamber;

a baffle mounted in the apparatus and operatively associated with the feed channel and having an edge disposed in spaced adjacency with the surface of the backing roll, and substantially parallel thereto, so as to form an overflow gap with either the paper web surface to be coated, when the web is supported on the backing roll surface, or the backing roll surface, when the paper web is not supported on the backing roll surface, and to provide for the escape of coating therethrough when coating is flowed through the feed channel;

a coating chamber in the coater head in fluid communication with the feed channel, and so constructed and arranged as to be open toward the backing roll for applying a film of coating to either the paper web surface to be coated, when the web is supported on the backing roll surface, or on the backing roll surface, when the paper web is not supported on the backing roll surface;

recirculation means in the coater head, and in fluid communication with the coating chamber and the mixing chamber for returning coating from the coating chamber to the mixing chamber to be combined with the fresh coating, and to establish, together with the feed channel, a continuous flow loop for circulation of coating within the coater head;

the recirculation means including a plurality of flow-metering orifices linking recirculation a channel with the mixing chamber, said orifices being so constructed and arranged as to form an acute angle with the inlet; and a flexible blade mounted to a surface of the coater head at a proximal end so that the flexible blade is only supported at the proximal end and having a distal end extending downstream therein, and defining, with the surface of the backing roll, the coating chamber on one surface of the blade, and defining, with the coater head, the recirculation channel on the other surface of the blade.

4. The apparatus for coating a traveling paper web of claim 3, wherein:

the coater head includes a stabilizer surface for defining a part of the coating chamber for assisting in the flow of coating downstream and against either the surface of the paper web to be coated or on the surface of the backing roll.

5. The apparatus for coating a traveling paper web of claim 3, further comprising:

a metering rod holder mounted in the apparatus for holding a rotatable metering rod for nipping engagement with either the coated paper web or the surface of the associated backing roll downstream of the coating chamber; and a metering rod rotatably mounted in the metering rod holder.

6. The apparatus for coating a traveling paper web of claim 5, further comprising:

drive means operatively connected to the metering rod for rotating the metering rod while the metering rod is in nipping, coating metering engagement with the coating material against either the coated web or the surface of the backing roll.

* * * * *

UNITED STATES PATENT AND TRADEMARK OFFICE

CERTIFICATE OF CORRECTION

PATENT NO. : 7,022,380 B2
APPLICATION NO. : 09/763214
DATED : April 4, 2006
INVENTOR(S) : Xuekui Lan et al.

It is certified that error appears in the above-identified patent and that said Letters Patent is hereby corrected as shown below:

In column 3, line 41 of the issued patent, delete the comma after the word "backing"

In column 10, line 25 of the issued patent, "recirculation a" should be written --a recirculation--

Signed and Sealed this

Eighteenth Day of July, 2006

JON W. DUDAS
*Director of the United States Patent and Trademark Office*